US008502767B2

(12) United States Patent
Lee et al.

(10) Patent No.: US 8,502,767 B2
(45) Date of Patent: Aug. 6, 2013

(54) DISPLAY APPARATUS AND CONTROL METHOD THEREOF

(75) Inventors: Sang-hoon Lee, Ulsan (KR); Jeong-il Kang, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 1348 days.

(21) Appl. No.: 11/762,519

(22) Filed: Jun. 13, 2007

(65) Prior Publication Data

US 2008/0100546 A1 May 1, 2008

(30) Foreign Application Priority Data

Oct. 25, 2006 (KR) ..... 10-2006-0103956

(51) Int. Cl.
*G09G 3/36* (2006.01)

(52) U.S. Cl.
USPC ..... 345/102; 345/30; 345/55; 345/82; 345/87

(58) Field of Classification Search
None
See application file for complete search history.

(56) References Cited

U.S. PATENT DOCUMENTS

| | | | | |
|---|---|---|---|---|
| 7,982,706 | B2 | 7/2011 | Ichikawa et al. | |
| 2006/0109205 | A1* | 5/2006 | Deng | 345/46 |
| 2006/0125744 | A1* | 6/2006 | Klein et al. | 345/82 |

FOREIGN PATENT DOCUMENTS

| | | | |
|---|---|---|---|
| KR | 10-2001-0098937 | A | 11/2001 |
| KR | 10-2002-0084125 | A | 11/2002 |
| KR | 10-2006-0056243 | A | 5/2006 |
| KR | 10-2006-0108226 | A | 10/2006 |

OTHER PUBLICATIONS

Communication dated Mar. 10, 2011, issued by the Korean Intellectual Property Office in counterpart Korean Patent Application No. 10-2006-0103956.

Communication dated Nov. 23, 2011 from the Korean Intellectual Property Office in counterpart Korean application No. 10-2006-0103956.

* cited by examiner

*Primary Examiner* — Sumati Lefkowitz
*Assistant Examiner* — Jesus Hernandez
(74) *Attorney, Agent, or Firm* — Sughrue Mion, PLLC

(57) ABSTRACT

A display apparatus comprising a display unit and a plurality of light emitting diodes (LEDs) provided in a backlight that illuminates the display unit, the display apparatus includes: a power supplier; a current detector which detects a value of a current flowing in each of the LEDs; a current adjusting unit which compares a target current value which is supplied to the LED with a current value detected by the current detector and controls the value of the current flowing in the LED; and a controller which determines the target current value based on grayscale information of a video signal which is displayed on the display unit, provides the target current value to the current adjusting unit, and provides a virtual target current value that is higher than the target current value to the current adjusting unit for a predetermined time period if the target current value is determined.

12 Claims, 4 Drawing Sheets

DISPLAY APPARATUS AND CONTROL METHOD THEREOF

CROSS-REFERENCE TO RELATED APPLICATIONS

This application claims priority from Korean Patent Application No. 10-2006-0103956, filed on Oct. 25, 2006, in the Korean Intellectual Property Office, the disclosure of which is incorporated herein by reference.

BACKGROUND OF INVENTION

1. Field of Invention

Apparatuses and methods consistent with the present invention relates to a display and control thereof, and more particularly, to a display apparatus using a light emitting diode (LED) as a light source.

2. Description of the Related Art

Recently, an increasing number of display apparatuses use an LED or a laser diode (LD) as a light source. With the use of the LED or LD as the light source, a greater variety of colors can be expressed, compared to a conventional light source of lamp, and color and brightness can be easily controlled by adjusting current flowing in the LED or LD.

The LED includes a plurality of arrays for three colors of red, green, and blue, and is used as a backlight of a display apparatus.

A conventional driving apparatus driving such an LED can be formed as a circuit as shown in FIG. 1. In the driving apparatus of FIG. 1, a current setting unit 9 sets a target current value Iref to be supplied to the LED based on a brightness of an image, and a control block 11 applies a voltage to a gate terminal of a transistor 7 for the current supplied from a power source 1 to flow in the LED 3.

In this case, the LED 3 may be formed of one LED or a plurality of LEDs in series or in parallel. In addition, the transistor 7 may be provided as a metal oxide semiconductor field effect transistor (MOSFET), a bipolar junction transistor (BJT) or a semiconductor that performs a function of the MOSFET or the BJT.

When the current flows in the LED 3, a current detector 5 detects the level Io of the current flowing in the LED 3 and provides a detected current value Io to the control block 11. The control block 11 includes a digital to analog (D/A) converter and an operational amplifier, compares the target current value Iref with the current value Io detected by the current detector 5, and controls the amount of current flowing in the LED 3.

That is, the control block 11 converts a predetermined current value set as a digital signal from a current setting unit 9 into an analog signal, and compares the analog signal with the detected current value. In addition, the control block 11 adjusts a gate voltage applied to the gate terminal of the transistor 7 so as to make the detected current value equal to the target current value Iref.

According to the above method, the control block 11 can control a desired-current value Io to flow in the LED 3 when an input voltage Vin supplied from the power source 1 is kept higher than a forward voltage drop Vak by a predetermined value.

However, a reference voltage of the D/A converter of the control block 11 and an offset voltage of the operational amplifier may vary depending on the parts of the D/A converter or the operational amplifier. Accordingly, a substantial value of a current flowing in the LED 3 may be different even though the same target current value Iref is applied from the current setting unit 9. Particularly, it is difficult to control value of the current flowing in the LED 3 to be equal to the target current value Iref due to errors in the reference voltage of the D/A converter and the offset voltage of the operational amplifier.

For example, assume that the current setting unit 9 sets the target current value Iref to 0. However, the analog signal of the target current value Iref may be 0 or less than 0 or greater than 0 due to an unpredictable offset that can be generated when the target current Iref in the form of a digital signal is converted into the form of an analog signal. When the target current value Iref becomes greater than 0 and thus a little current flows in the LED 3, an image may be displayed on a screen with an unintended grayscale level.

In order to solve this problem, a circuit can be designed to apply a sufficient negative (−) offset to make the detected current value become 0. However, the control block 11 may apply a negative value to the gate terminal G of the transistor 7 if the detected current value becomes 0 by the negative offset. Since the transistor 7 is in a complete off state when the gate voltage has the negative value, a time delay occurs between a time at which the target current value Iref is set and a time at which a current value flowing in the LED 3 reaches the target current value Iref.

SUMMARY OF THE INVENTION

Accordingly, it is an aspect of the present invention to provide a display apparatus reducing a time delay before an LED of a backlight is driven, and a control method thereof.

Another aspect of the present invention is to provide a display apparatus that can precisely express grayscales by optimizing an LED driving method, and a control method thereof.

Additional aspects of the present invention will be set forth in part in the description which follows and, in part, will be obvious from the description, or may be learned by practice of the present invention.

The foregoing and/or other aspects of the present invention can be achieved by providing a display apparatus comprising a display unit and a plurality of light emitting diodes (LEDs) provided in a backlight that illuminates the display unit, the display apparatus comprising: a power supplier; a current detector which detects a value of a current flowing in each of the LEDs; a current adjusting unit which compares a target current value which is supplied to the LED with a current value detected by the current detector and controls the value of the current flowing in the LED; and a controller which determines the target current value based on grayscale information of a video signal which is displayed on the display unit, provides the target current value to the current adjusting unit, and provides a virtual target current value that is higher than the target current value to the current adjusting unit for a predetermined time period if the target current value is determined.

According to the embodiment of the present invention, a light emitting diode (LED) driving apparatus further comprises: an amplifier; wherein the amplifier comprises a transistor, the current adjusting unit is connected to a gate terminal of the transistor, and the current adjusting unit changes a voltage value applied to the gate terminal so as to control a value of the current flowing in the LED from the power supplier.

According to the embodiment of the present invention, when the virtual target current value is provided to the current adjusting unit, the controller compares a gate voltage of the transistor with a predetermined virtual voltage and provides the target current value to the current adjusting unit when the virtual voltage is less than the gate voltage.

According to the embodiment of the present invention, when the virtual target current value is provided to the current adjusting unit, the controller compares a voltage applied to the current detector with a predetermined virtual voltage and provides the target current value to the current adjusting unit when the virtual voltage is less than the value of the current flowing in the current detector.

The foregoing and/or other aspects of the present invention can be achieved by providing a method for controlling a display apparatus comprising a display unit, a plurality of light emitting diodes (LEDs) provided in a backlight, a current detector which detects a value of the current flowing in the LED, and a current adjusting unit which adjusts the value of the current flowing in the LED, the method comprising: setting a target current value based on grayscale information of a video signal which is displayed on the display unit; providing the target current value to the current adjusting unit; providing a virtual target current value that is higher than the target current value to the current adjusting unit during a predetermined time period; providing the target current value to the current adjusting unit after the predetermined time period is passed; and adjusting the value of the current flowing in the LED by comparing the target current value with the detected current value detected by the current detector.

According to the embodiment of the present invention, the display apparatus comprises an amplifier, and the adjusting of the value of the current flowing in the light emitting diode (LED) comprises adjusting the value of the current flowing in the LED by modifying a voltage applied to the amplifier by the current adjusting unit.

According to the embodiment of the present invention, the providing of the virtual target current value to the current adjusting unit comprises: comparing a voltage applied to the amplifier with a predetermined virtual voltage; and providing the target current value to the current adjusting unit when the virtual voltage is less than the voltage applied to the amplifier.

According to the embodiment of the present invention, the providing of the virtual target current value to the current adjusting unit comprises: comparing a voltage applied to the current detector with a predetermined virtual voltage; and providing the target current value to the current adjusting unit when the virtual voltage is less than the gate voltage.

BRIEF DESCRIPTION OF THE DRAWINGS

The above and/or other aspects of the present invention will become apparent and more readily appreciated from the following description of the exemplary embodiments, taken in conjunction with the accompanying drawings, in which.

DETAILED DESCRIPTION OF EXEMPLARY EMBODIMENTS OF THE INVENTION

Figure 1:
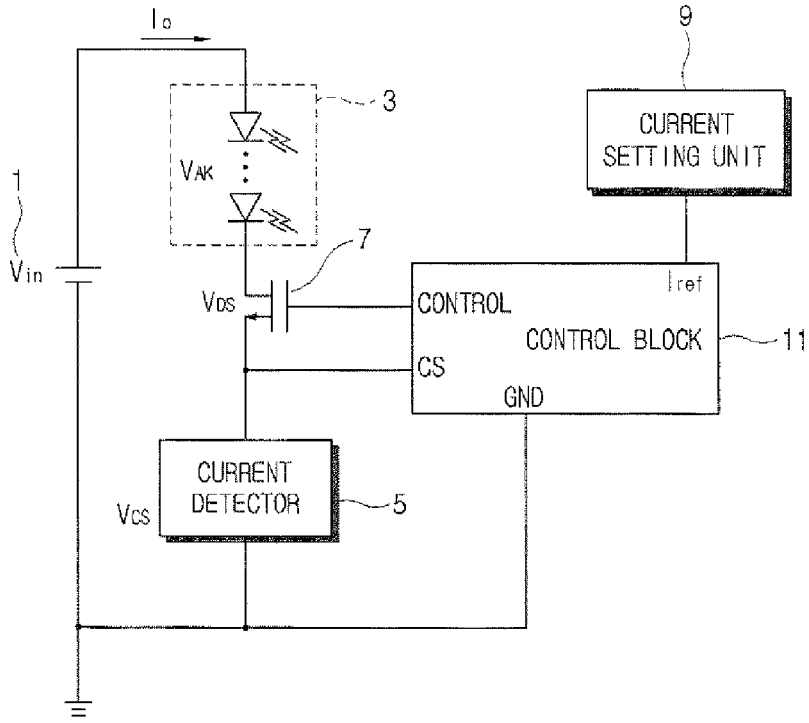
FIG. 1 (RELATED ART)
FIG. 1 is a circuit diagram of a conventional LED driving apparatus.

Reference will now be made in detail to the embodiments of the present invention, examples of which are illustrated in the accompanying drawings, wherein like reference numerals refer to like elements throughout. The exemplary embodiments are described below so as to explain the present invention by referring to the figures.

A first exemplary embodiment of the present invention will be described in further detail with reference to the accompanying drawings.

Figure 2:
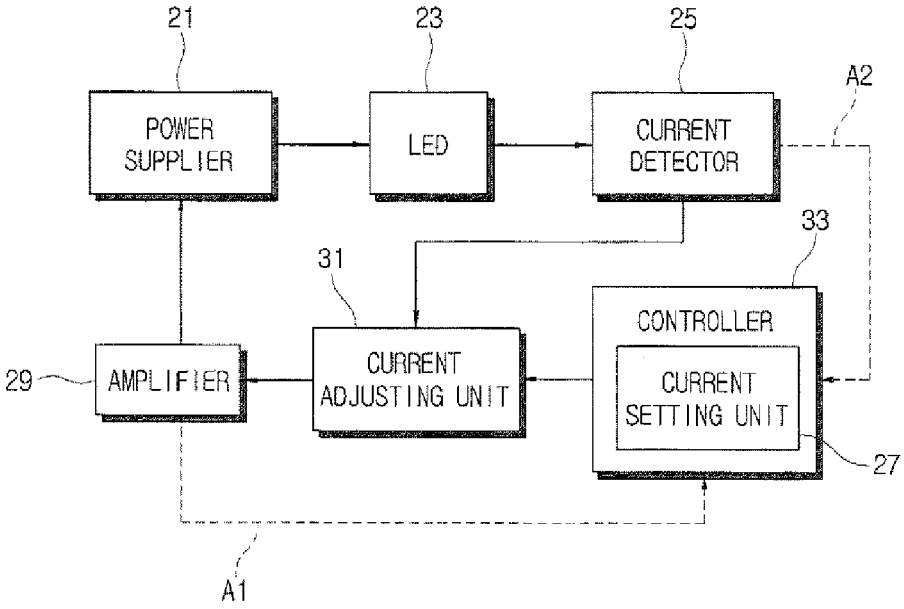
FIG. 2 is a control block diagram of an LED driving circuit of a display apparatus according to first and second exemplary embodiments of the present invention.

FIG. 2 is a control block diagram of a light emitting diode (LED) driving apparatus which drives an LED used as a backlight of a display apparatus according to the first exemplary embodiment of the present invention. The LED driving apparatus according to the first exemplary embodiment of the present invention comprises a power supply 21, an LED 23, a current detector 25, an amplifier 29, a current adjusting unit 31, and a controller 33.

In this case, the LED 23 illuminates a display unit (not shown) on which an image is displayed, and may be formed of a plurality of LEDs 23 coupled in series or in parallel. The display apparatus according to the first exemplary embodiment of the present invention may include an R-LED driving apparatus for driving a red LED (R-LED) that emits red wavelength light, a G-LED driving apparatus for driving a green LED (G-LED) that emits green wavelength light, and a B-LED driving apparatus for driving a blue LED (B-LED) that emits blue wavelength light, respectively.

The current detector 25 detects a value of the current flowing in the LED 23, and provides the detected current value to the controller 33.

The current detector 25 according to the first exemplary embodiment of the present invention may be realized by using at least one resistor or Hall sensor. Since a value of the current flowing in the current detector 25 equals a value of the current flowing in the LED 23, the current detector 25 can detect the value Io of the current flowing in the LED 23 by using a voltage at an input terminal of the current detector 25.

The current adjusting unit 31 is coupled to the amplifier 29 and adjusts the value Io of the current flowing in the LED 23 so as to adjust luminance of light emitted by the LED 23. The current adjusting unit 31 may include a digital to analog (D/A) converter and an operational amplifier.

That is, the current adjusting unit 31 compares a target current value set by the controller 33 with a current value detected by the current detector 25, and adjusts the detected current value to be equal to the target current value. In this case, the current adjusting unit 31 adjusts the amount of current supplied to the LED 23 from the power supply 21 by controlling a voltage applied to the amplifier 29.

The amplifier 29 receives a voltage from the current adjusting unit 31 and allows power to flow to the LED 23 from the power supply 21, and can be provided as a transistor. The amplifier 29 according to the first exemplary embodiment of the present invention is exemplarily provided as a serial regulator using a MOSFET or a bipolar junction transistor.

Each block of the LED driving apparatus according to the first exemplary embodiment of the present invention will be described in further detail with reference to FIG. 3. Herein, the constituent elements of the LED 23, the amplifier 29, and the current detector 25 of the LED driving apparatus may be coupled in a different order depending on the type of the amplifier 29 or a current detection method.

The amplifier 29 includes a gate terminal G, a drain terminal D, and a source terminal S. As shown in FIG. 3, the gate terminal G of the amplifier 29 is coupled to the current adjusting unit 31 so that the current flows between the drain terminal D and the source terminal S by a gate voltage applied to the gate terminal G from the current adjusting unit 31.

In general, if the gate voltage applied to the gate terminal G from the current adjusting unit 31 increases more and more, an electric field is generated and a current flows between the drain terminal D and the source terminal S. In this case, the amount of the current flowing between the drain terminal D and the source terminal S is exponentially increased as the gate voltage increases. When the gate voltage exceeds a threshold voltage, the amplifier 29 lies in an on state.

The controller 33 sets a target current value to be supplied to the LED 23, and provides a virtual target current value to the current adjusting unit 31 once the target current value is set. The controller 33 can be provided as a central processing unit (CPU) or a micro computer (MICOM).

As shown in FIG. 2, the controller 33 includes the current setting unit 27 for setting the target current value. The current setting unit 27 checks grayscale information included in a video signal which is inputted through a signal input unit (not shown), and determines brightness of an image to be displayed on a display unit (not shown).

In addition, the current setting unit 27 sets a target current value to be supplied to the LED 23 for the determined brightness, and provides the set target current value to the current adjusting unit 31.

When the target current value is provided to the current adjusting unit 31 by the controller 33, the current adjusting unit 31 is synchronized by the target current value and applies a gate voltage to the gate terminal G of the amplifier 29.

When the current adjusting unit 31 applies a gate voltage to the gate terminal G, the controller 33 provides a virtual target current value that is higher than the target current value, instead of the target current value to the current adjusting unit 31 so as to increase the gate voltage applied to the amplifier 29 from the current adjusting unit 31. Herein, the virtual target current value may be set to be high enough to reduce time delay, and can be set experimentally.

In addition, the controller 33 provides the virtual current value to the current adjusting unit 31 for a predetermine time period. In this case, an image can be displayed without any interruption by sufficiently lowering the duration of the time during which the virtual target current value is applied to the current adjusting unit 31 to, for example, 0.1 sec.

When a predetermined time is passed, the target current value set by the current setting unit 27 is provided to the current adjusting unit 31 and the current adjusting unit 31 adjusts a value of the current flowing in the LED 23 to be equal to the target current value by comparing the target current value with a detected current value.

When a frame of an input video signal is changed, the current setting unit 27 resets the target current value based on the changed frame. Therefore, the controller 33 performs the above-described process in the cycle of one frame.

Accordingly, the virtual target current value is provided to the current adjusting unit 31 for the predetermined time period so that a time delay between a time at which the target current value is set and a time at which a value of the current flowing in the LED 23 reaches the target current value can be reduced, thereby solving a drawback of the conventional display apparatus.

In addition, a short and constant time delay is provided without regarding the target current value.

A display apparatus according to a second exemplary embodiment of the present invention will be described in more detail with reference to FIG. 2 and FIG. 3. Descriptions of constituent elements that are the same as those of the display apparatus according to the first exemplary embodiment of the present invention will be omitted.

A controller 33 according to the second exemplary embodiment provides the current adjusting unit 31 with a target current value instead of a virtual target current value, the target current value being based on a predetermined virtual voltage Vs, and further includes a comparator.

Figure 3:
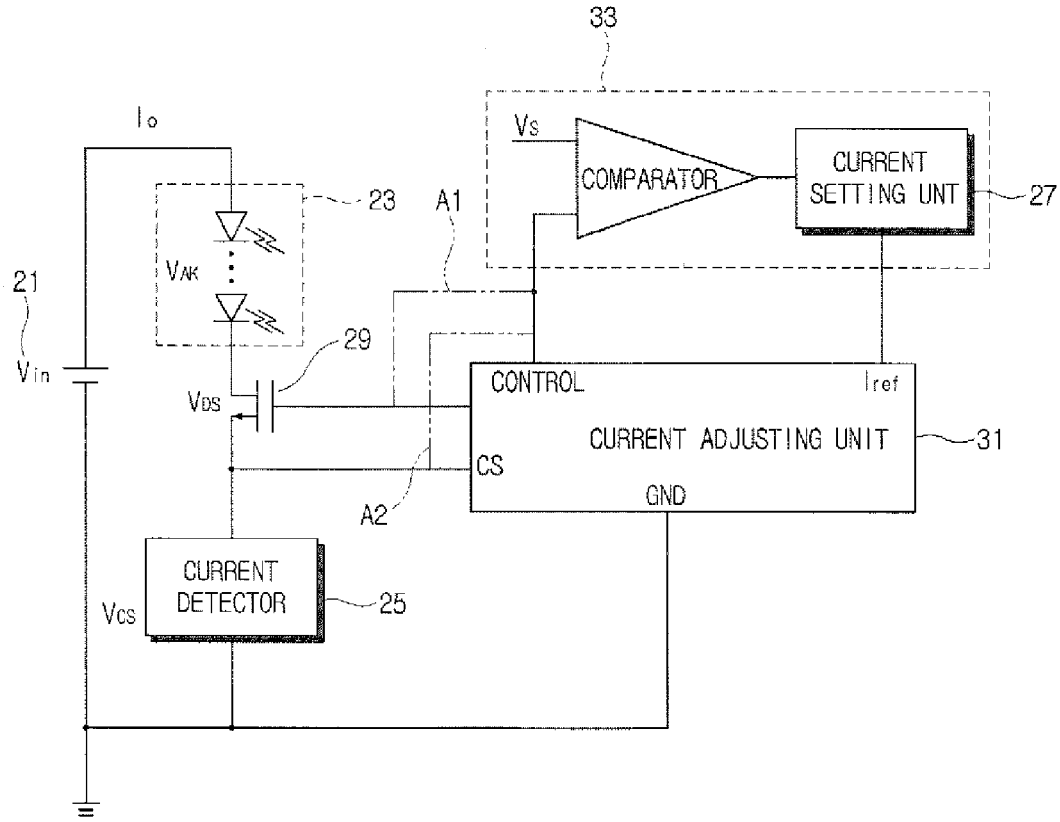
FIG. 3 shows a circuit diagram of the LED driving circuit of the display apparatus according to the second exemplary embodiment of the present invention.

As shown in FIG. 3, the comparator may be connected to a gate terminal G of an amplifier 29 through a first path A1, or connected to a current detector 25 through a second path A2.

When the comparator is connected through the first path A1, the predetermined virtual voltage Vs is applied to a non-inverting input terminal of the comparator, and the comparator outputs a logical high signal when the virtual voltage Vs at the gate terminal G is less than a gate voltage at the gate terminal G. Herein, depending on a circuit configuration, the comparator may output a logical low signal when the virtual voltage Vs is less than the gate voltage.

When the comparator is connected through the second path A2, the predetermined virtual voltage Vs is applied to the non-inverting input terminal of the comparator, and the comparator compares the virtual voltage Vs with a voltage Vcs applied to the current detector 25. When the virtual voltage Vs is less than the voltage Vcs applied to the current detector 25, the comparator outputs a logical high signal.

When receiving the high signal from the comparator, the controller 33 provides the current adjusting unit 31 with a target current value changed from the virtual target current value that has been provided to the current adjusting unit 31.

The virtual target current value is constantly supplied until the gate voltage of the amplifier 29 or the voltage applied through the circuit reaches a predetermined virtual voltage value such that the time delay between the time at which the target current value is set and the time at which the value of the current flowing in the LED 23 reaches the target current value can be reduced, thereby improving grayscale expression capability.

A control method of the display apparatus according to the first exemplary embodiment of the present invention will be described.

Figure 4:
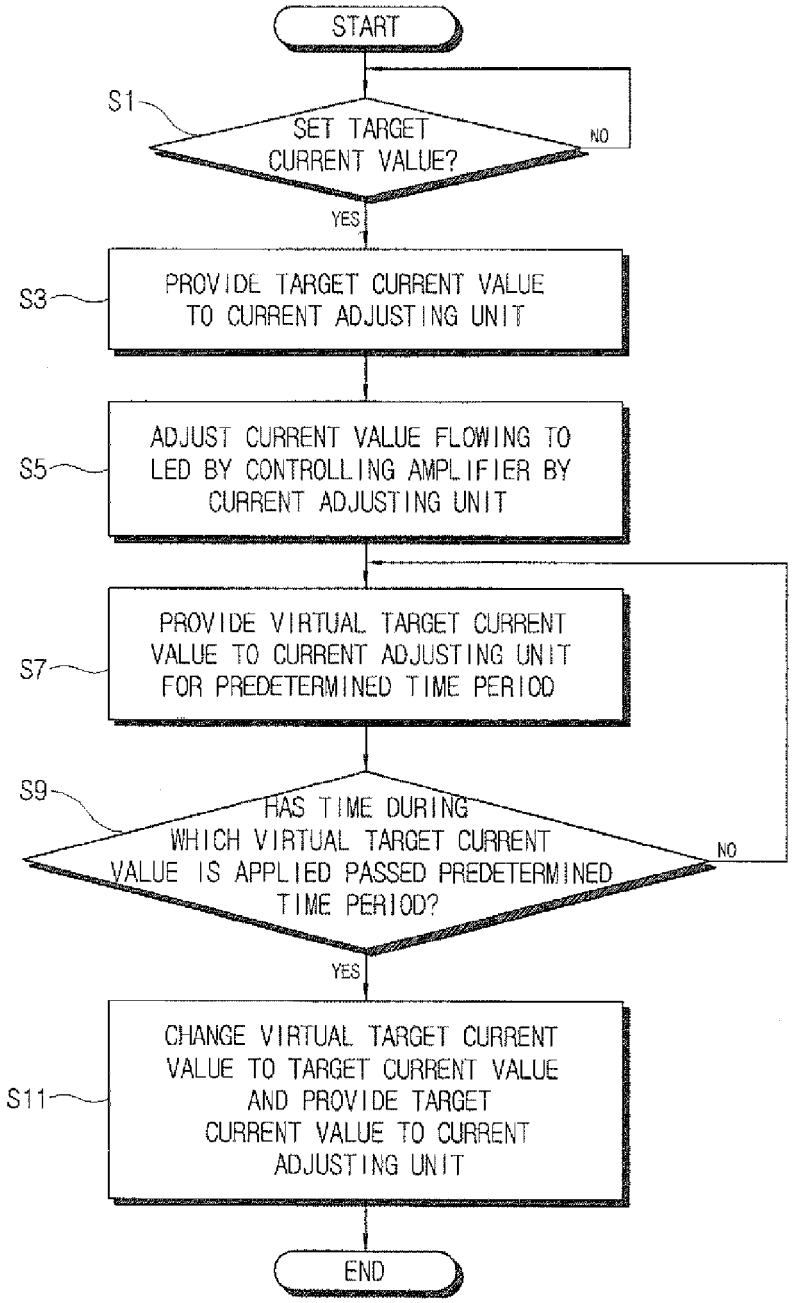
FIG. 4 is a flowchart of a control process of the display apparatus according to the first exemplary embodiment of the present invention.

As shown in FIG. 4, the current setting unit 27 of the controller 33 sets a target current value based on grayscale information of a video signal to be displayed on a display unit (not shown) at operation S1. The target current value is a current value to be supplied to the LED 23.

The target current value is provided to the current adjusting unit 31 at operation S3. The current adjusting unit 31 synchronized by the target current value control the amplifier 29 as to adjust the value of the current flowing in the LED 23 at operation S5.

In addition, a virtual target current value that is higher than the target current value is provided to the current adjusting unit 31 for a predetermined time period instead of the target current value, at operation S7. As described above, the virtual target current value may be set to be high enough to reduce the conventional time delay problem, and it can be set experimentally.

Then, duration of the time period during which the virtual target current is provided to the current adjusting unit 31 is counted, at operation S9.

After a predetermined time is passed, the controller 33 changes the virtual target current value to a target current value and provides the target current value to the current adjusting unit 31 and controls the current adjusting unit 31 to adjust a value of the current flowing in the LED 23 based on a result of comparison between the target current value and a current value detected by the current detector 25, at operation S11.

Therefore, the time delay between the time at which the target current value is set and the time at which the value of the current flowing in the LED reaches the target current value can be reduced, thereby improving grayscale expression capability.

As described above, the present invention provides a display apparatus reducing a time delay between a time at which a target current value is set and a time at which a value of the current flowing in the LED reaches the target current value, and a control method thereof.

In addition, a short and constant time delay can be maintained without regarding the level of the target current value.

Although a few exemplary embodiments of the present invention have been shown and described, it will be appreciated by those skilled in the art that changes may be made in these exemplary embodiments without departing from the principles and spirit of the invention, the scope of which is defined in the appended claims and their equivalents.

What is claimed is:

1. A display apparatus having a display unit and a backlight comprising a plurality of light emitting diodes (LEDs) that illuminates the display unit, the display apparatus comprising:

a power supply;

a current detector which detects a value of a current flowing in an LED of the plurality of LEDs;

a current adjusting unit which compares a target current value which is supplied to the LED of the plurality of LEDs with a current value detected by the current detector and controls the value of the current flowing in the LED of the plurality of LEDs; and a controller which determines the target current value based on grayscale information of a video signal which is displayed on the display unit, provides a virtual target current value instead of the target current value to the current adjusting unit for a first time period, wherein the virtual target current value is higher than the target current value, and provides the target current value to the current adjusting unit for a second time period which is from an end of the first time period to a time that the value of the current flowing in the LED arrives at the target current value, wherein an increasing rate of the value of a current flowing in the LED for the first time period is larger than an increasing rate for the second time period.

2. The display apparatus of claim 1, further comprising:

an amplifier comprising a transistor, wherein the current adjusting unit is connected to a gate terminal of the transistor, and based on the target current value or the virtual target current value, the current adjusting unit changes a voltage value applied to the gate terminal to control the value of the current flowing in the LED of the plurality of LEDs, from the power supply.

3. The display apparatus of claim 2, wherein, if the virtual target current value is provided to the current adjusting unit, the controller compares a gate voltage of the transistor with a predetermined virtual voltage and provides the target current value to the current adjusting unit instead of the virtual target current value if the predetermined virtual voltage is less than the gate voltage.

4. The display apparatus of claim 2, wherein if the virtual target current value is provided to the current adjusting unit, the controller compares a voltage applied to the current detector with a predetermined virtual voltage and provides the target current value to the current adjusting unit instead of the virtual target current value if the predetermined virtual voltage is less than the value of the current flowing in the current detector.

5. A method for controlling a display apparatus having a display unit, a backlight including a plurality of light emitting diodes (LEDs), a current detector which detects a value of a current flowing in an LED of the plurality of LEDs, and a current adjusting unit which adjusts the value of the current flowing in the LED of the plurality of LEDs, the method comprising:

setting a target current value based on grayscale information of a video signal displayed on the display unit;

providing a virtual target current value instead of the target current value to the current adjusting unit for a first time period, wherein the virtual target current value is higher than the target current value;

providing the target current value instead of the virtual target current value to the current adjusting unit for a second time period which is from a time that the first time period lapses to a time that the value of the current flowing in the LED arrives at the target current value;

adjusting the value of the current flowing in the LED of the plurality of LEDs by comparing the target current value with the detected current value detected by the current detector, and wherein an increasing rate of the value of a current flowing in the LED for the first time period is larger than the increasing rate for the second time period.

6. The method of claim 5, wherein the adjusting of the value of the current flowing in the LED of the plurality of LEDs comprises, based on the target current value or the virtual target current value, adjusting the value of the current flowing in the LED of the plurality of LEDs by modifying a voltage applied to an amplifier of the display apparatus, by the current adjusting unit.

7. The method of claim 6, wherein the providing of the virtual target current value to the current adjusting unit comprises:

comparing a voltage applied to the amplifier with a predetermined virtual voltage; and providing the target current value to the current adjusting unit instead of the virtual target current value if the virtual voltage is less than the voltage applied to the amplifier.

8. The method of claim 5, wherein the providing of the virtual target current value to the current adjusting unit comprises:

comparing a voltage applied to the current detector with a predetermined virtual voltage; and providing the target current value to the current adjusting unit instead of the virtual target current value if the virtual voltage is less than the gate voltage.

9. A display apparatus for controlling currently a current flowing to a light emitting diode (LED), the display apparatus comprising:

a power supply;

a current detector which detects a first current flowing in the LED;

a current adjusting unit which compares a target current supplied to the LED with the detected first current and controls the first current flowing in the LED;

a controller which determines the target current based on grayscale information of a video signal being displayed, provides a virtual target current instead of the target current to the current adjusting unit for a first time period, wherein the virtual target current is higher than the target current, and provides the target current to the current adjusting unit for a second time period which is from a time that the first time period lapses to a time that the current flowing in the LED arrives at the target current, and wherein an increasing rate of the current flowing in the LED for the first time period is larger than the increasing rate for the second time period.

10. A method for controlling a light emitting diode (LED), a current detector which detects a first current flowing in the LED, and a current adjusting unit which adjusts the first current, the method comprising:

setting a target current based on grayscale information of a video signal being displayed;

providing a virtual target current instead of the target current value to the current adjusting unit during a first time period, wherein the virtual target current is higher than the target current;

providing the target current instead of the virtual target current to the current adjusting unit for a second time period which is from a time that the first time period lapses to a time that the value of the current flowing in the LED arrives at the target current value; and adjusting the first current flowing in the LED by comparing the target current with the first current detected by the current detector, wherein an increasing rate of the value of a current flowing in the LED for the first time period is larger than the increasing rate for the second time period.

11. The display apparatus of claim 2, wherein, upon receiving the target current value, the current adjusting unit applies the voltage value corresponding to the target current value to the gate terminal of the amplifier, when the current adjusting unit initially applies the voltage value to the gate terminal of the amplifier, the controller provides the virtual target current value instead of the target current value to the current adjusting unit for the first time period, and the current adjusting unit adjusts the voltage value to the gate terminal to correspond to the virtual target current value for the first time period.

12. The display apparatus of claim 11, wherein when the first time period lapses, the controller provides the target current value instead of the virtual target current value to the current adjusting unit, and the current adjusting unit adjusts the voltage value to the gate terminal to correspond to the target current value.

* * * * *